US008261915B2

(12) United States Patent
Bailey et al.

(10) Patent No.: US 8,261,915 B2
(45) Date of Patent: Sep. 11, 2012

(54) SCREENING MACHINE AND ASSOCIATED SCREEN PANEL

(75) Inventors: Scott A. Bailey, Cincinnati, OH (US); Brady P. Ballman, Loveland, OH (US); Nicholas P. Gardner, Cincinnati, OH (US); James G. Potter, Harrison, OH (US)

(73) Assignee: Rotex Global, LLC, Cincinnati, OH (US)

( * ) Notice: Subject to any disclaimer, the term of this patent is extended or adjusted under 35 U.S.C. 154(b) by 516 days.

(21) Appl. No.: 12/468,937

(22) Filed: May 20, 2009

(65) Prior Publication Data

US 2009/0230029 A1 Sep. 17, 2009

Related U.S. Application Data

(63) Continuation-in-part of application No. 11/382,353, filed on May 9, 2006, which is a continuation-in-part of application No. 11/295,259, filed on Dec. 6, 2005, now abandoned.

(60) Provisional application No. 61/060,833, filed on Jun. 12, 2008.

(51) Int. Cl.
*B07B 1/46* (2006.01)

(52) U.S. Cl. ..... 209/405; 209/408

(58) Field of Classification Search ..... 209/404, 209/405, 408, 409, 410, 412, 413
See application file for complete search history.

(56) References Cited

U.S. PATENT DOCUMENTS

| | | | | |
|---|---|---|---|---|
| 1,932,920 | A | 10/1933 | Berghoefer | |
| 2,114,406 | A | 4/1938 | Simpson | |
| 2,213,773 | A | 9/1940 | Symons | |
| 2,723,032 | A | 11/1955 | Gisler et al. | |
| 2,867,324 | A * | 1/1959 | Hirs | 210/97 |
| 3,081,874 | A | 3/1963 | Corbin et al. | |
| 3,176,843 | A * | 4/1965 | Hoskins et al. | 209/403 |
| 3,406,823 | A | 10/1968 | Crain | |
| 4,040,951 | A * | 8/1977 | Cole | 209/408 |
| 4,224,146 | A * | 9/1980 | Kent et al. | 209/243 |

(Continued)

FOREIGN PATENT DOCUMENTS

GB 2322590 2/1998

OTHER PUBLICATIONS

S. Howes, Inc., Snappy Shaker, Brochure, 2008, 2 pgs.

(Continued)

*Primary Examiner* — Joseph C Rodriguez
(74) *Attorney, Agent, or Firm* — Wood, Herron & Evans, LLP

(57) ABSTRACT

A screening machine of the type used to separate or classify mixtures of solid particles of different sizes includes a machine frame and a perforate screen panel mounted for movement relative to the machine frame during a screening operation. The screen panels are pre-tensioned mesh screen material mounted in a peripheral rim for separating various granular and particulate materials. The screen panel is slid into the side of the machine frame in a direction orthogonal to the direction particulate matter moves when the screening machine is operating. The screen panel peripheral rim has a shaped or other cross section adapted to hold a large seal member that provides a positive sealing surface for contact with the machine frame to prevent particulate matter from escaping off of the screen panel during use.

25 Claims, 4 Drawing Sheets

U.S. PATENT DOCUMENTS

| | | | | | |
|---|---|---|---|---|---|
| 4,303,509 | A | | 12/1981 | Lilie | |
| 4,582,597 | A | * | 4/1986 | Huber | 209/313 |
| 4,728,422 | A | | 3/1988 | Bailey | |
| 4,820,407 | A | | 4/1989 | Lilie | |
| 4,846,352 | A | * | 7/1989 | Bailey | 209/399 |
| 5,385,669 | A | | 1/1995 | Leone, Sr. | |
| 5,417,859 | A | | 5/1995 | Bakula | |
| 5,456,365 | A | * | 10/1995 | Janssens et al. | 209/403 |
| 5,614,094 | A | | 3/1997 | Deister | |
| 5,615,776 | A | | 4/1997 | Bjorklund et al. | |
| 5,636,749 | A | | 6/1997 | Wojciechowski | |
| 5,735,409 | A | | 4/1998 | Malmberg | |
| 5,851,393 | A | | 12/1998 | Carr et al. | |
| 5,967,336 | A | | 10/1999 | Baltzer et al. | |
| 6,006,923 | A | | 12/1999 | Helmy et al. | |
| 6,053,329 | A | | 4/2000 | Ballman | |
| 6,070,736 | A | | 6/2000 | Ballman et al. | |
| 6,202,856 | B1 | | 3/2001 | Carr | |
| 6,269,954 | B1 | | 8/2001 | Baltzer | |
| 6,431,368 | B1 | | 8/2002 | Carr | |
| 6,443,310 | B1 | | 9/2002 | Schulte, Jr. et al. | |
| 6,484,885 | B1 | | 11/2002 | Lilie et al. | |
| 6,672,460 | B2 | | 1/2004 | Baltzer | |
| 6,708,829 | B2 | | 3/2004 | Robertson et al. | |
| 6,901,870 | B2 | * | 6/2005 | Eklof et al. | 112/103 |
| 7,063,214 | B2 | | 6/2006 | Schulte, Jr. et al. | |
| 7,516,851 | B2 | * | 4/2009 | DeCenso et al. | 209/420 |
| 2003/0066786 | A1 | | 4/2003 | Seyffert et al. | |
| 2004/0238434 | A1 | | 12/2004 | Fisher et al. | |
| 2007/0125688 | A1 | | 6/2007 | Ballman et al. | |
| 2008/0245707 | A1 | | 10/2008 | Smith | |
| 2009/0308795 | A1 | | 12/2009 | Smith | |

OTHER PUBLICATIONS

International Searching Authority, International Search Report and The Written Opinion of the International Searching Authority, or the Declaration, Jun. 30, 2008, 8 pgs.

* cited by examiner

SCREENING MACHINE AND ASSOCIATED SCREEN PANEL

This claims priority to U.S. Provisional Patent Application Ser. No. 61/060,833, filed Jun. 12, 2008, and is a continuation in part of and claims priority to U.S. patent application Ser. No. 11/382,353, filed May 9, 2006, which in turn was a continuation in part of and claimed priority to U.S. patent application Ser. No. 11/295,259, filed Dec. 6, 2005. Each of these identified prior applications is hereby incorporated by reference in its entirety.

BACKGROUND OF THE INVENTION

This invention relates to screening machines of the type used to separate or classify mixtures of solid particles of different sizes. The invention also relates to screening machines of the type used for liquid/solid separations, i.e., for separating solid particles of specific sizes from a liquid in which they are carried. More particularly, the invention relates to an improved screen panel for use within the screening machine.

In screening machines of the type described, a screen (which may be woven, an aperture plate or another design) is mounted in what is often called a "screen frame" or "screen deck" which includes a supporting peripheral frame around the perimeter of the screen. Some screens are tensioned when they are installed in the screening machine and other screens are pre-tensioned in a frame prior to being installed in the machine. Typically associated with the screen deck are other material handling elements that are moved with the screen and form walls or partitions above or below the screen for containing the liquid and/or particulate materials adjacent to the screen and directing them to appropriate outlets. These elements may include a top cover and a pan beneath the screen deck. In the case of screening machines with multiple screens or deck units, spacer pans or frames are provided between the multiple screens.

The screens are often removed from the screening machines for cleaning, replacement, readjustment, or installation of a screen of a different mesh size or the like. The screen is releasably mounted to a carrier, table or box to which vibratory motion is imparted, typically by one or more eccentric motors or other means of excitation. The carrier, table or box is referred to herein as a "vibratory carrier". The vibratory carrier may be moved in oscillatory, vibratory, gyratory, gyratory reciprocating, fully gyratory, rotary or another type of motion or combinations thereof, all of which are herein collectively referred to as "vibratory" motion or variations of that term.

In large commercial screening machines, the weight of the various components including the screen assembly carried by the vibratory carrier, and the weight of the material being processed on the screen assembly may total several hundred pounds or more. Screening machines which tension the screen, as opposed to those utilizing pre-tensioned screens, include the added weight associated with the screen tensioning mechanism and related components. This presents a very substantial inertial mass that resists the changes of motion applied thereto by the vibratory drive acting through the vibratory carrier. As a result of these inertial forces, a relative motion may exist between the vibratory carrier and the screen assembly. Typically, the screen assembly and vibratory carrier are each constructed of metal that could result in significant noise, wear and damage due to the relative motion or rubbing action there between. The resulting impact forces between the screen assembly and vibratory carrier significantly increase the stresses on the components and reduce their useful life.

Reducing the metal-to-metal contact minimizes the wear on the various metal components and the noise associated with the operation of the screening machine. Currently, certain screen assembly designs may not be sealed or secured relative to the remainder of the screening machine, particularly in larger screening machines. This results in the above-described metal-to-metal contact between the screen assembly and the remainder of the screening machine and prevents the screening of very fine material, such as sand or the like. The screens in larger screening machines are typically inserted and/or removed from the machine in a generally horizontal, longitudinal direction typically through an opening or slot at the head or foot end of the machine. This method of installation and removal of the screen is detrimental to known sealing arrangements because a seal that would engage the screen assembly could be torn or damaged during the installation/removal of the screen. In other screening machines, the screen is inserted vertically, typically from the top of the machine. Access to the screens from the top of the machine or the longitudinal ends is often very inconvenient and difficult.

Thus, it would be desirable to provide a screen panel and screening machine to overcome these and other aspects of screening machines and screen panels.

SUMMARY OF THE INVENTION

The above-described and other problems with prior art screening machines and associated screen panels have been resolved by this invention. Screening machines according to one embodiment of this invention utilize a machine frame, a perforate screen assembly engaging the machine frame, and a driver imparting vibratory motion to the screen assembly, the machine frame and screen assembly designed to hold particulate matter to be screened. The screening machine also includes a first outlet which discharges a first portion of the particulate matter that remains on top of the screen assembly and a second outlet which discharges a second portion of the particulate matter that passes through the screen assembly.

One aspect of this embodiment is the screen assembly including a screen panel having a generally planar screening surface and a peripheral rim or outer edge extending around at least a portion of the screening surface and being recessed, offset or beveled relative to the screening surface. A seal member positioned relative to the screening surface. The peripheral profile of the screen panel also enhances the strength of the panel so that the tensioning forces of the screen material will not alter the shape of the screen panel. In one embodiment, the rim on the screen panel has a shaped cross section designed to hold the seal member. The rim in one embodiment can also include rounded corners so that the seal member is one continuous seal attached around the perimeter of the screen panel.

The machine frame in one embodiment includes lining rails that engage the seal member of the screen panel when the screen panel is inserted into the screening machine. The seal member closes any gap between the lining rails of the machine frame and the screen panel so that particulate matter cannot escape to the interior components of the screening machine. The machine frame may also include transition caps permanently sealed to each lining rail, and the transition caps help ensure a proper seal between the screen panel and the machine frame.

Therefore, according to various embodiments of this invention, the screening operation is much more efficient and more easily accomplished while offering significant advantages in screen service life, strength, installation and removal while avoiding the opportunities for operator error when installing the screen panel.

BRIEF DESCRIPTION OF THE DRAWINGS

The objectives and features of the various embodiments and features of the invention will become more readily apparent from the following detailed description taken in conjunction with the accompanying drawings in which.

DETAILED DESCRIPTION OF THE INVENTION

Figure 1:
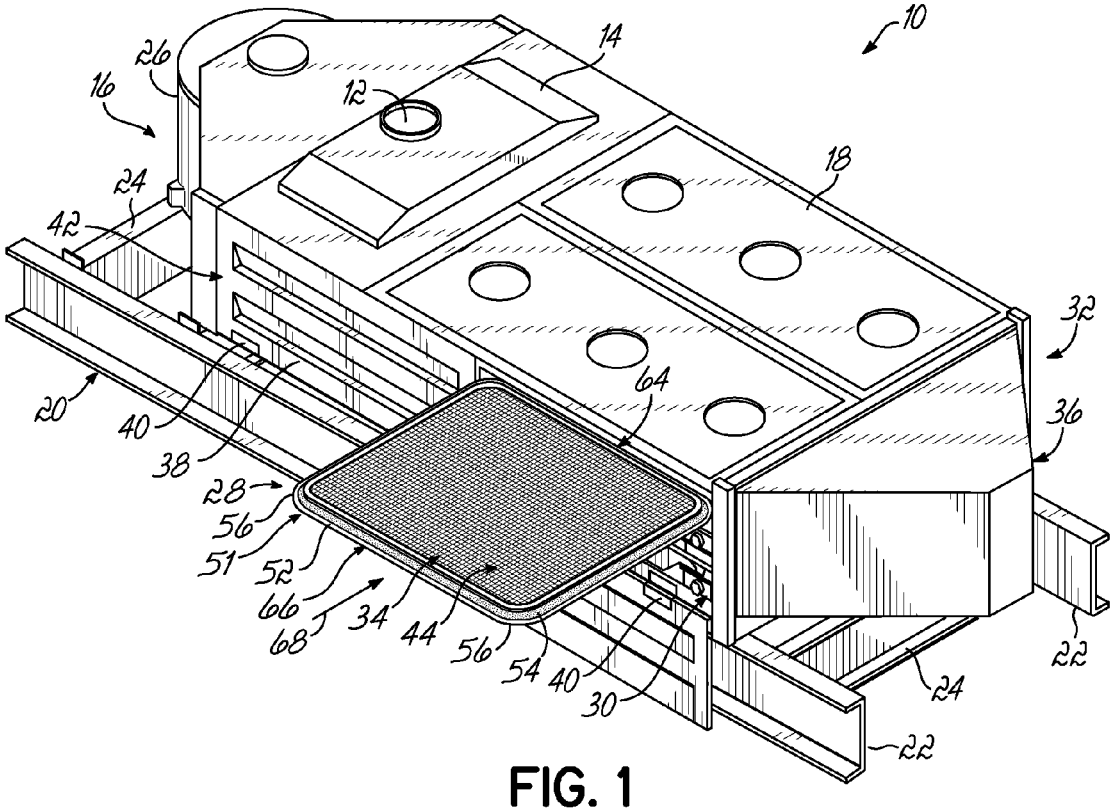
FIG. 1 is a perspective view of an exemplary screening machine and associated screen panel being installed therein according to one embodiment of this invention.

Referring to FIG. 1, an exemplary embodiment of a screening machine 10 in which this invention may be used is shown. Screening machines of many types are sold commercially by Rotex, Inc. of Cincinnati, Ohio, the assignee of this invention. However, this invention is not limited to any particular type of screening machine design or application and the machine shown and disclosed herein is only for illustrative purposes.

The screening machine 10 includes an inlet port 12 near an inlet section 14 proximate a head end 16 of the machine 10. The screening machine 10 may also include a top cover 18 in any one of a variety of forms. Particulate or other material to be screened is fed into the inlet port 12 from a hopper (not shown) for screening and processing by the machine 10.

The screening machine 10 is supported structurally by a machine frame 20 including beams 22 connected together by laterally oriented struts 24 on each end of the screening machine 10. The screening machine 10 includes an electric motor 26 coupled to a drive weight (not shown) to impart an oscillatory, vibratory, gyratory, gyratory reciprocating, fully gyratory, or other motion or combinations thereof (herein collectively referred to as "vibratory" motion or variations of that term) to at least the head end 16.

Within a screening chamber of the screening machine 10, one or more screen panels 28 are each mounted in combination to form one or more screen assemblies 30 to receive the material being screened from the feed chute 12 at the head end 16 of the machine 10. The screen panels 28 are mounted on slightly sloping planes (approximately 4°) with the head end thereof being slightly elevated relative to a foot end so that during the screening process the material advances, in part by gravity, over the screen panels 28 toward a discharge end 32 of the machine 10. Even though the screen panels 28 of the screening machine 10 may be on a slightly sloping plane, to provide a reference for the purposes of clarity herein, these components will be considered to be generally horizontal and the direction perpendicular or orthogonal to the screen panels 28 will generally be referred to as a vertical orientation or direction. The direction of travel of the material being screened from the head end 16 to the discharge end 32 across the screen panels 28 is referred to as the longitudinal direction and the perpendicular orientation extending from side to side on the screen panels 28 is a lateral direction.

In the embodiment of the screening machine 10 shown in FIG. 1, upper and lower screen assemblies 30 each include four screen panels 28 mounted generally coplanar with each other in the associated screen assembly 30. Accordingly, as the material to be screened is deposited from the inlet port 12 onto the upper screen assembly 30, the vibratory motion of the screening machine 10 advances the material longitudinally across the top of the screen panels 28 of the upper screen assembly 30 toward the discharge end 32. Appropriately sized and configured material passes through the upper screen assembly 30 and falls onto the lower screen assembly 30. The screen panels 28 of the upper screen assembly 30 may include a fine mesh screen material 34 adjacent the inlet port 12 through which dust and other fine particulate matter passes for collection and discharge. Certain material also passes through the upper screen assembly 30 and is deposited on the lower screen assembly 30. Therefore, the lower screen assembly 30 is included to provide an additional separating mechanism for the appropriately sized particles to pass through the lower screen assembly 30 for collection in a lower pan (not shown).

The unacceptably sized particles remain atop the first upper screen assembly 30 and fall off the terminal edge thereof into a collection basin for discharge through a first outlet (not shown) in the exit section 36. Material that passes through the upper screen assembly 30 and remains atop the lower screen assembly 30 falls off the terminal edge thereof and into the collection basin for discharge through a second outlet (not shown) in the exit section 36. The first and second outlets are separated by a baffle (not shown) to keep the classified particles separate from one another. The acceptably sized particles that pass through both the upper and lower screen assemblies 30 are collected in a lower pan and discharged through a third outlet (not shown) located at the discharge end 32 of the machine 10.

Referring to FIG. 1, one or more doors 38 are each pivotally connected by a hinge 40 to a lateral side 42 of the screening machine 10. When opened, the doors 38 provide access for insertion and removal in the lateral direction of the screen panels 28. It will be appreciated that although one side 42 of the screening machine 10 is shown in FIG. 1, additional doors 38 on the opposite side of the screening machine 10 may also be provided. Advantageously, the screen panels 28 are inserted horizontally and laterally or perpendicularly to the longitudinal direction of travel of the material being screened in the screening machine 10.

Figure 2:
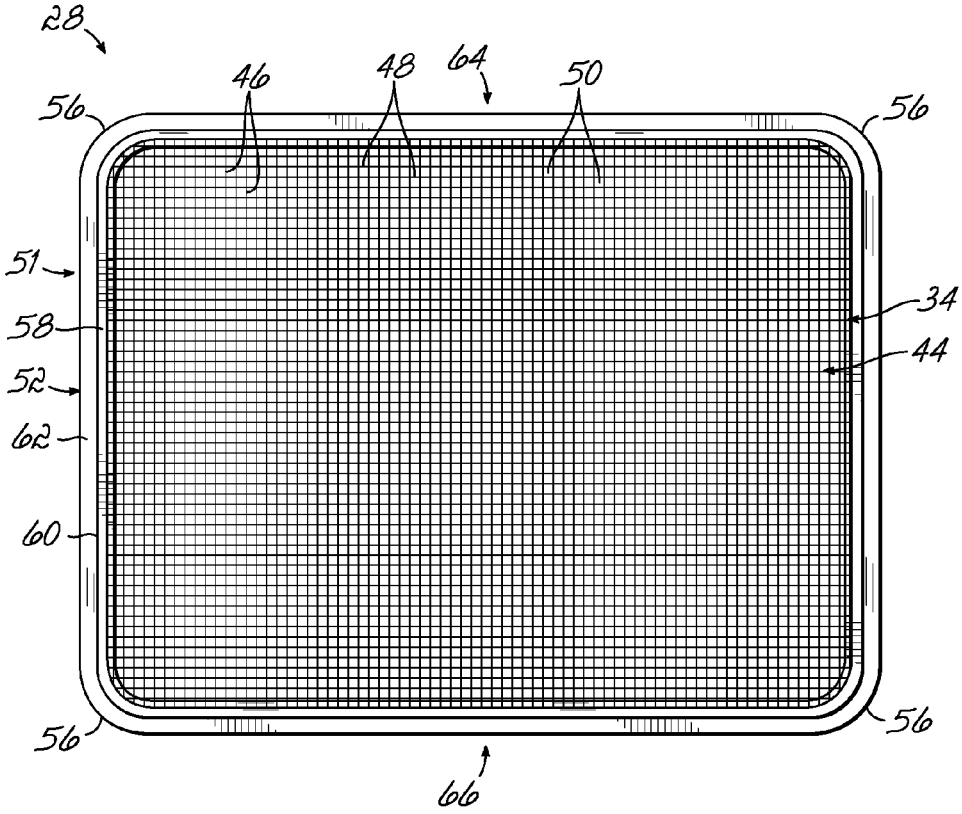
FIG. 2 is a top plan view of the screen panel of FIG. 1.
Figure 3:
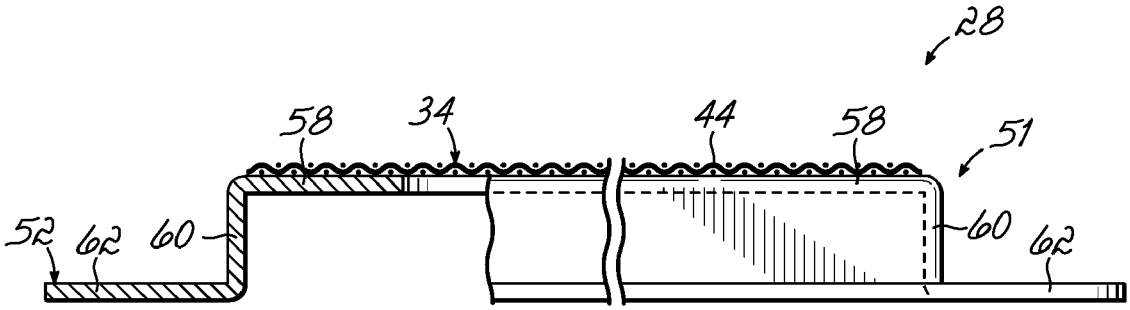
FIG. 3 is a front, partially cross-sectional view of the screen panel of FIG. 2.

Referring to FIGS. 2-3, one embodiment of the screen panel 28 includes a generally perforated mesh screen material 34 making a screening surface 44. The mesh screen material 34 includes a number of intersecting longitudinal threads or wires 46 and lateral threads or wires 48 which are oriented orthogonally to each other to provide appropriately sized and configured openings 50 in the screening surface 44 to prevent or allow the passage of particulate matter. The screen panel 28 includes a generally rigid frame 51 with a peripheral rim 52 extending around at least a portion of the screening surface 44. At least a portion of the peripheral rim 52 is recessed, offset or beveled relative to the screening surface 44, and the peripheral rim 52 can have a shaped cross section designed to accept a seal member 54. Alternatively, the peripheral rim 52 includes a cross section with a generally horizontal first portion 58 adapted to hold the mesh screen material 34, a generally vertical second portion 60 integral with first portion 58, and a generally horizontal third portion 62 integral with the second portion 60. The portion 62 may be offset or recessed relative to the screening surface 44 and/or may be positioned at a lower surface of the screen panel 28. Alternatively, the rim 52 may be of a different configuration or location relative to the screening surface 44 including spaced from the lower surface of the screen panel 28. The portion 62 is shown in FIG. 3 as being oriented perpendicularly to the portion 60 and generally parallel to the screening surface 44. Alternatively, the rim 52 may be of a different configuration or orientation relative to the screening surface 44 including obliquely oriented relative to the screening surface 44.

Figure 2A:
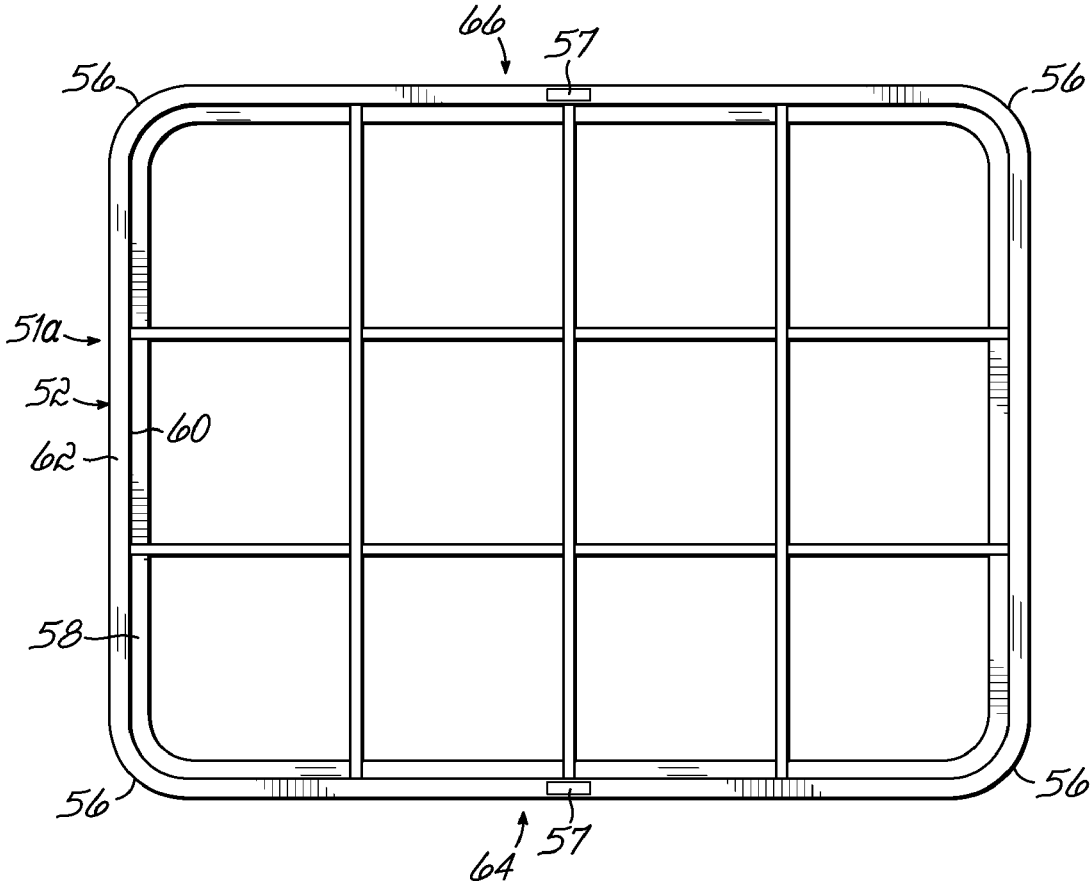
FIG. 2A is a bottom plan view of an alternative embodiment of a screen panel frame.

An alternative embodiment of a frame 51*a* of the screen panel 28 according to this invention is shown in FIG. 2A. Frame 51*a* includes a lattice arrangement 53 inside the peripheral rim 52 to provide added stiffness to the screen panel 28. The added stiffness assists in maintaining tension on the screen material 54 (not shown in FIG. 2A). The lattice arrangement 53 of FIG. 2A includes longitudinal members 55*a* intersecting lateral members 55*b* oriented orthogonally to each other. The members 55*a*, 55*b* may be generally flat members with rectangular cross sections, rounded bars with circular cross sections, or of another shape within the scope of this invention. Further alternative embodiments of this invention include screen panels 28 with only longitudinal members 55*a*, only lateral members 55*b* and members 55*a*, 55*b* intersecting in non-orthogonal orientations.

The members 55*a*, 55*b* may be tack welded to each other at their common points of intersection and at their intersection with the peripheral rim 52. Adhesive is an alternative to the welding according to alternative embodiments. Moreover, the lattice arrangement 53 may be integral with the peripheral rim 52 as a result of a burnout design or other production technique.

The seal member 54 in one embodiment is coupled to the peripheral rim 52 along the second portion 60 and third portion 62 of the cross section of the peripheral rim 52. Alternatively, the seal member 54 may be positioned at other locations on the screen panel 28 relative to the rim 52. The peripheral rim 52 in one embodiment also has rounded corners 56 which allow the seal member 54 to be a continuous seal member 54 that follows the rounded corners 56 without buckling. The rounded corners 56 also allow for clearance room for internal hardware (not shown) inside the machine frame 20. The corners 56 may be produced by a stamping operation to enhance quality and lower production costs. The rim 52 in FIG. 2 is shown as extending entirely around the perimeter of the screen panel 28, but other configurations are possible within the scope of this invention, including portions of the rim only along the trailing and/or leading edges of the screen panel 28.

The screen panel 28 may be manufactured by a variety of processes, including stretching a mesh screen material 34 to put longitudinal wires 46 and lateral wires 48 in tension, robotically applying adhesives to a peripheral rim 52, raising the peripheral rim 52 up into the mesh screen material 34, curing with ultraviolet light for about 30 seconds, and trimming or grinding off any excess wire 46, 48. The screen material 34 may be bonded to the peripheral rim 52 via adhesive or welding in alternative embodiments. A seal member 54 is then permanently mounted on the peripheral rim 52. In some embodiments, a silicone bead can be installed on the perimeter where the ends of wires 46, 48 are exposed. This silicone bead is not necessary in all embodiments, as the seal member 54 can be large enough to cover the exposed ends of wires 46, 48. In another embodiment, the screen panel 28 can be manufactured by dipping the peripheral rim 52 in epoxy and pressing the mesh screen material 34 onto the peripheral rim 52 with a heat press. Additionally, the screen panel 28 of FIG. 2 is shown with the screen material 34 tensioned uninterrupted within the confines of the rim 52. Other embodiments are included within the scope of this invention, including smaller cells defined within the interior of the rim 52 by transverse and longitudinally extending ribs within the peripheral rim 52. Additionally, one or more labels 57 can be included on a lower surface of the frame 51 (FIG. 2A) to permit identification of the panel 28 while it is installed in the machine 10.

Another aspect of this invention is the ability to recondition existing screen panels 28 when the screen material 34 is torn, worn, used or otherwise in need of replacement. The frame and rim 52 of the screen panel typically are not damaged or worn and are capable of repeated use. As such, the used screen material 34 is removed from the frame and rim 52 and likely the seal member 54 as well. New screen material of the same type, material mesh and the like or of different characteristics relative to the used screen material is positioned on the frame, tensioned, bonded to the frame and trimmed to size as appropriate and previously described herein above. A new seal member 54 is then applied to the screen panel 28 and it is ready to be returned to service.

The screen panel 28 of the current embodiment has several advantages over conventional screen panels. The shaped cross section of the peripheral rim 52 allows for a large seal member 54 to be permanently attached to the screen panel 28, removing the need to carefully position the screen panel 28 within the machine frame 20 to ensure a good seal. The shaped cross section also allows for a continuous seal 54 around each panel 28 in one uniform plane while maintaining a flush product flow surface between the panels 28 and internal components of the machine 10. Screen panels 28 of other embodiments include interior lattice arrangement 53 (FIG. 2A) connected to the peripheral rim to support the tension levels of the mesh screen material. With a shaped cross section, the peripheral rim 52 has an increased stiffness allowing for the optional removal of the lattice network and promoting better conveying and blinding control. Conventional screen panels required calibration of seal size to varying wire thicknesses in the mesh screen material, but the current embodiment's large compliant seal member 54 makes the seal effectiveness far less sensitive to varying wire 46, 48 sizes in the mesh screen material 34. These improvements create more economical manufacturing processes and more reliable seals in a screening machine 10.

The leading side edge 64 of the screen panel 28 is typically inserted laterally into the machine frame 20 through door 38 as shown by arrow 68 in FIG. 1. A user or operator can easily grab the trailing side edge 66 thanks to the shaped cross section of the peripheral rim 52 and the large seal member 54 protecting the hands of the user or operator from exposed wire. In some embodiments, the user slides the screen panel 28 over a vibratory ball tray (not shown) or other device that has balls or agitation producing members that bounce against the underside of screen panel 28 to reduce blinding or other occlusion of the mesh screen material 34 when the electric motor 26 provides vibratory motion to the machine 10. Advantageously, the screen panel 28 in this embodiment can be removed and replaced for manual cleaning or other maintenance without removing the heavier ball tray.

Figure 4A:
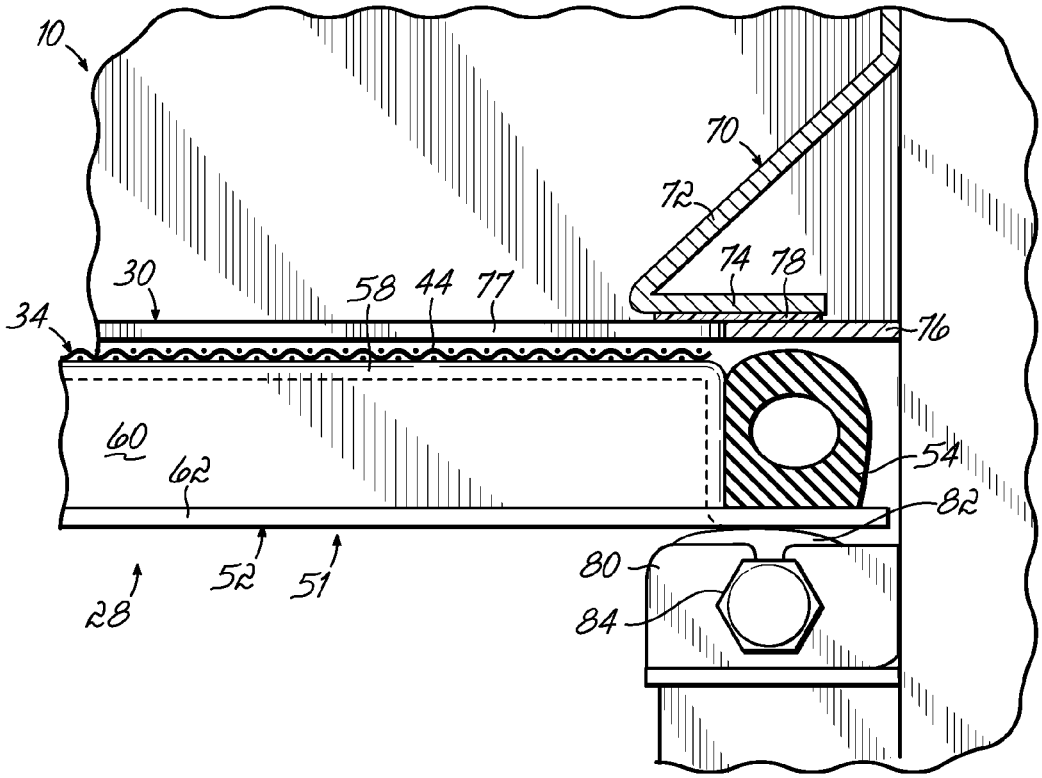
FIG. 4A is a side elevational view of a portion of the screening machine of FIG. 1 and a screen panel inserted therein prior to a screening operation.
Figure 4B:
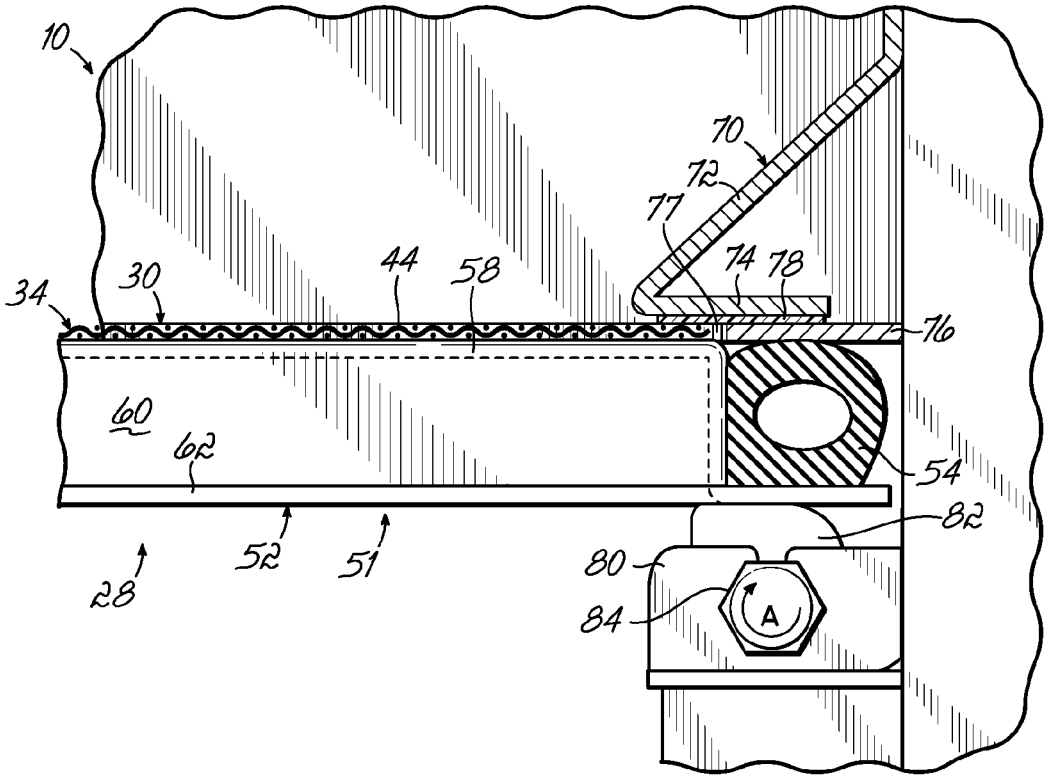
FIG. 4B is a view similar to FIG. 4A with the screen panel engaged with the machine frame of the screening machine in preparation for a screening operation.

Referring now to FIGS. 4A-4B, the placement and configuration of a screen panel 28 inside the screening machine 10 according to one embodiment will now be described. The machine frame 20 of the screening machine 10 includes lining rails 70 permanently attached to the interior of machine frame 20, the lining rails 70 including a downwardly-angled portion 72 and a horizontal portion 74 below the angled portion and designed to engage the screen panel 28. The lining rails 70 can be slightly resilient to allow vibration with the machine frame 20 to force particulate matter onto the screening surface 44. Also permanently attached to the interior of the machine frame 20 are transition caps 76, generally horizontal edge pieces that engage the screen panel 28 and the lining rail 70 to eliminate leakage concerns and eliminate any time needed for fixturing during assembly. Below the lining rails 70 and adjacent to the transition caps 76 is an upper portion 77 of screen assembly 30. A flat seal member 78 on the underside of the transition caps 76 rests between the lining rails 70 and the transition caps 76 and upper portion 77.

The machine frame 20 further includes a bracket 80 in which a rotational cam 82 is located. The peripheral rim 52 in one embodiment of the screen panel 28 is supported on the rotational cam 82 when initially inserted in the screening machine 10 as illustrated in FIG. 4A. The rotation of the cam 82 is accomplished by an actuator 84 accessible to the operator or user when the door 38 of the machine 10 is open. For example, one known mechanism suitable for use with this invention to raise/lower the screen panel 28 is disclosed in Rotex' U.S. Pat. No. 6,070,736, which is incorporated by reference herein.

Upon rotation of the actuator 84 in the direction of arrow A, the cam 82 is rotated, thereby raising the screen panel 28 supported thereon upwardly to sealing engagement with upper portion 77 of screen assembly 30 as shown in FIG. 4B. As the screen panel 28 is raised, the mesh screen material 34 is juxtaposed on the upper portion 77 and the seal member 54 is compressed against transition cap 76, upper portion 77, and lining rail 70. As a result, the upper portion 77 of screen assembly 30, the screen panel 28, and the lining rails 70 are sealed to prevent and inhibit the discharge of particulate matter being screened into other interior components of the machine frame 20. Due to the design and configuration of the screen panel 28, machine frame 20 and seal member 54, the seal member 54 is neither damaged nor compromised during lateral installation of the screen panel 28, thus extending the service life of the associated components. The invention thus offers a screen panel 28 that is pre-tensioned, ready to use, lightweight, standardized in size to lower cost, simple design, mass producible, easy to handle, and stronger or stiffer than conventional screen panels of similar weight.

Figure 5A:
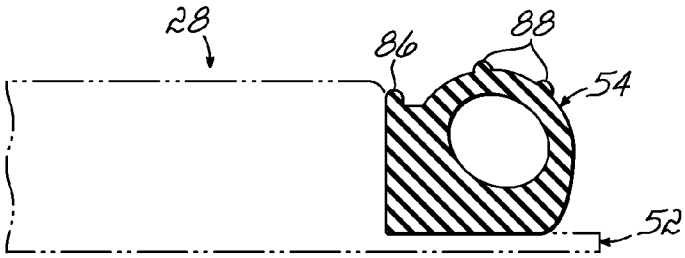
FIGS. 5A-5E are side cross-sectional views of alternative embodiments of a seal member attached to the screen panel.
Figure 5B:
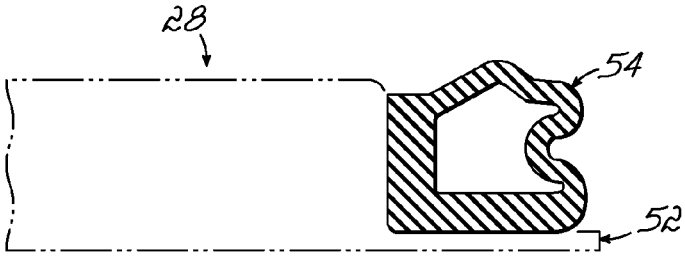
Figure 5C:
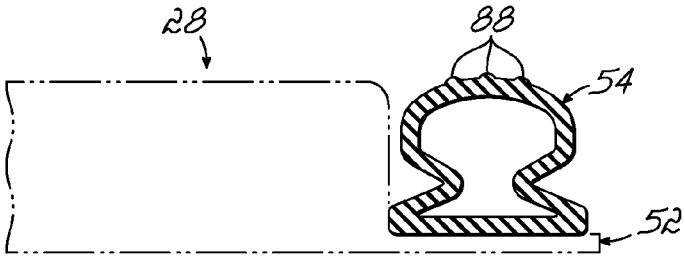
Figure 5D:
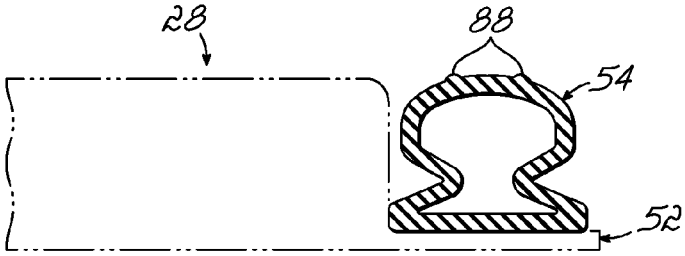
Figure 5E:
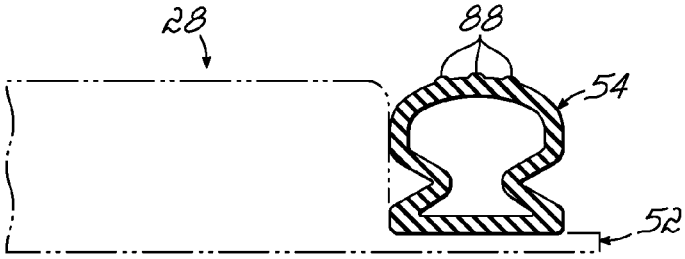

Referring now to FIGS. 5A-5E, alternative embodiments of large seal members 54 for use on screen panel 28 are illustrated. In FIG. 5A, a typical round seal member 54 is attached to screen panel 28. The embodiment in FIG. 5A includes a seal lip 86 which helps cover exposed wire ends of mesh screen material 34 and also extends to further fill the gap between the machine frame 20 and the screen panel 28 when the screen panel 28 is raised by cam 82 into engagement with the machine frame 20 as shown in FIG. 4B. This seal lip 86 allows for minor manufacturing tolerances and insertion forgiveness. The embodiment illustrated in FIG. 5B is another possible large seal member 54 with an irregular cross section for more resiliency or seal effectiveness. Seal members 54 of FIGS. 5A and 5C-5E each include ridges 88 which assist in improving the overall sealing effectiveness of the member 54. One skilled in the art will recognize that many other possible configurations are possible of seal members used with the screen panel 28 of this invention.

In another unillustrated embodiment, screening machine 10 could also include a removable seal holder as well as the machine frame 20 and the screen panel 28. The removable seal holder would include the large seal member 54 and be a resilient holder to be sandwiched between the machine frame 20 and the screen panel 28 when screen panel 28 is raised into engagement with the machine frame 20. This would allow the seal to be reuseable and extend the life of individual components of the screening machine 10 beyond the previously described embodiments.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A screening machine comprising:

a machine frame having lining rails permanently attached to the interior thereof;

a perforate screen assembly engaging the machine frame and onto which particulate material to be screened is discharged; and a driver coupled to the screen assembly adapted to impart vibratory motion to the screen assembly and promote separation of the particulate material by the screen assembly;

wherein the screen assembly further comprises at least one screen panel adapted to be selectively inserted into and removed from the screening machine, the at least one screen panel having a generally planar screening surface and a screen panel frame with a peripheral rim extending around at least a portion of the screening surface and being at least partially recessed relative to the screening surface with a seal member mounted to the screen panel frame, the seal member engaging the lining rails of the machine frame when the screen panel is inserted into the screening machine;

wherein the cross section of the rim of the screen panel has a generally horizontal first portion adapted to hold pre-tensioned wire mesh screen material, a generally vertical second portion integral with and substantially perpendicular to the first portion, and a generally horizontal third portion substantially perpendicular and integral with the second portion;

wherein the seal member comprises a lip adjacent to the intersection of the first portion and the second portion of the rim, and the lip is adapted to fill the void between the machine frame and the screen panel when the screen panel is inserted into the screening machine.

2. The screening machine of claim 1 wherein at least a portion of the rim on each of the screen panels is oriented generally parallel with the generally planar screening surface.

3. The screening machine of claim 1 wherein the rim on each of the screen panels extends entirely around the perimeter of the screen panel.

4. The screening machine of claim 1 wherein the seal member on each of the screen panels extends entirely around the perimeter of the screening surface.

5. The screening machine of claim 1 further comprising:

a screen material pre-tensioned to the screen panel frame.

6. The screening machine of claim 1 wherein an outermost edge portion of the rim is juxtaposed to a lower surface of the screen panel.

7. The screening machine of claim 1 wherein the seal member is juxtaposed to the second portion and the third portion of the cross section of the rim of the screen panel.

8. The screening machine of claim 1 wherein the engagement between the seal member and the lining rails seals interior components of the screening machine from the particulate material.

9. The screening machine of claim 8 wherein the machine frame further comprises transition caps permanently coupled to each lining rail and adapted to further ensure a proper seal between the screen panel and the machine frame.

10. The screening machine of claim 1 further comprising:

a plurality of the screen panels, a first set of the screen panels being generally coplanar with each other and a second set of the screen panels being generally coplanar with each other and spaced vertically from the first set.

11. The screening machine of claim 1 wherein each screen panel is inserted laterally into the screening machine in a direction generally perpendicular to a longitudinal axis of the screening machine.

12. The screening machine of claim 11 further comprising:

a door on a lateral side of the screening machine which, when opened, provides access to laterally insert the screen panel into the screening machine.

13. The screening machine of claim 1 further comprising:

a lining rail; and a transition cap;

wherein the lining rail and transition cap in combination define an opening within the screening machine which is sized and configured to receive therein the screening surface of the screen panel.

14. The screening machine of claim 13 wherein the screening surface of the screen panel is generally coplanar and forms a continuous surface with the transition cap when inserted in the opening.

15. The screening machine of claim 13 wherein the seal member is attached to the perimeter of the screen panel and contacts an underside of the lining rail and the transition cap to inhibit material from passing off of the screening surface when positioned in the opening without being screened.

16. The screening machine of claim 1 further comprising:

an actuator to selectively raise and lower the screen panel into and out of position respectively, in the screening machine for screening operations.

17. The screening machine of claim 16 further comprising:

a transition cap;

wherein the screening surface of the screen panel is generally coplanar and forms a continuous surface with the transition cap when the screen panel is raised by the actuator into position for screening operations.

18. The screening machine of claim 16 further comprising:

a ball tray containing a plurality of cleaning members and underlying the screen panel, the ball tray and cleaning members moving with the screen panel.

19. A screen panel for selective insertion into and removal from a screening machine having a machine frame including lining rails permanently attached to the interior thereof, the screen panel comprising:

a frame;

a screen material defining a generally planar screening surface and securably attached to the frame, the screen material being pre-tensioned to the frame;

a peripheral rim extending around at least a portion of the frame; and a seal member disposed on the rim for selectively engaging the lining rails of the machine frame of the screening machine when the screen panel is inserted into the screening machine;

wherein the cross section of the rim of the screen panel has a generally horizontal first portion adapted to hold pre-tensioned wire mesh screen material, a generally vertical second portion integral with and substantially perpendicular to the first portion, and a generally horizontal third portion substantially perpendicular and integral with the second portion;

wherein the seal member comprises a lip adjacent to the intersection of the first portion and the second portion of the rim, and the lip is adapted to fill the void between the machine frame and the screen panel when the screen panel is inserted into the screening machine.

20. The screen panel of claim 19 wherein at least a portion of the rim is oriented generally parallel with the generally planar screening surface.

21. The screen panel of claim 19 wherein the rim extends entirely around the perimeter of the screen panel.

22. The screen panel of claim 19 wherein the seal member extends entirely around the perimeter of the screening surface.

23. The screen panel of claim 19 wherein the rim extends entirely around the perimeter of the screen panel.

24. The screen panel of claim 19 wherein an outermost edge portion of the rim is juxtaposed to a lower surface of the screen panel.

25. A screening machine comprising:

a machine frame including a lining rail and a transition cap;

a perforate screen assembly engaging the machine frame and onto which particulate material to be screened is discharged;

a first and a second outlet, a first portion of the particulate matter that remains atop the screen assembly being discharged through the first outlet and a second portion of the particulate material that passes through the screen assembly being discharged through the second outlet; and a driver coupled to the screen assembly adapted to impart vibratory motion to the screen assembly and promote separation of the particulate material by the screen assembly into the first and second portions;

wherein the screen assembly further comprises at least one screen panel adapted to be selectively removed from the screening machine, the at least one screen panel having a generally planar screening surface and a screen panel frame with a peripheral rim extending around at least a portion of the screening surface and being at least partially recessed relative to the screening surface with a seal member mounted to the screen panel frame;

a door on a lateral side of the screening machine which, when opened, provides access to laterally insert the screen panel into the screening machine;

an actuator to selectively raise and lower the screen panel into and out of position respectively, in the screening machine for screening operations;

wherein the lining rail and transition cap in combination define an opening within the screening machine which is sized and configured to receive therein the screening surface of the screen panel and wherein the screening surface of the screen panel is generally coplanar and forms a continuous surface with the transition cap when the screen panel is raised by the actuator into the opening; and a ball tray containing a plurality of cleaning members and underlying the screen panel, the ball tray and cleaning members moving with the screen panel.

* * * * *